US009815169B2

(12) United States Patent
Byrn et al.

(10) Patent No.: US 9,815,169 B2
(45) Date of Patent: Nov. 14, 2017

(54) HONING TOOL

(71) Applicant: Ford Motor Company, Dearborn, MI (US)

(72) Inventors: Matthew Wayne Byrn, Livonia, MI (US); Paul John Bojanowski, Macomb Township, MI (US); Dennis W. Doebler, New Baltimore, MI (US); Thomas Frasier, Farmington Hills, MI (US)

(73) Assignee: Ford Motor Company, Dearborn, MI (US)

( * ) Notice: Subject to any disclaimer, the term of this patent is extended or adjusted under 35 U.S.C. 154(b) by 45 days.

(21) Appl. No.: 14/866,061

(22) Filed: Sep. 25, 2015

(65) Prior Publication Data

US 2017/0087686 A1 Mar. 30, 2017

(51) Int. Cl.
*B24B 33/08* (2006.01)

(52) U.S. Cl.
CPC ..... *B24B 33/086* (2013.01)

(58) Field of Classification Search
CPC ..... B24B 33/00; B24B 33/105; Y10T 408/85892–408/85895
USPC ..... 451/470, 540
See application file for complete search history.

(56) References Cited

U.S. PATENT DOCUMENTS 156,137 A * 10/1874 Cook ..... B23B 29/03446 408/161
972,139 A * 10/1910 York ..... B23D 77/042 408/166
1,027,554 A * 5/1912 Lugenbill ..... B23B 29/03417 408/168
1,212,971 A * 1/1917 Loomer ..... B23B 29/03421 408/156
1,325,556 A * 12/1919 Countryman ..... B23B 29/03417 408/163
1,576,788 A * 3/1926 Restel ..... B24B 33/08 451/476
2,083,400 A * 6/1937 Rose ..... B24B 33/086 451/478
2,412,419 A * 12/1946 Palotsee ..... B24B 33/08 451/476
2,467,094 A * 4/1949 Peden ..... B24B 33/086 451/478
2,799,127 A * 7/1957 Sunnen ..... B24B 33/086 29/432
2,823,498 A * 2/1958 Saunders ..... B24B 33/086 451/478
3,995,400 A * 12/1976 Gillette ..... B24B 33/086 451/476
3,998,011 A 12/1976 Corley
(Continued)

*Primary Examiner* — Larry E Waggle, Jr.
*Assistant Examiner* — Henry Hong
(74) *Attorney, Agent, or Firm* — Damian Porcari; Brooks Kushman, P.C.

(57) ABSTRACT

A head assembly of a honing tool includes a carrier having a proximal end connectable to a spindle, a distal end, and a plurality of stones. The head assembly also includes a pilot cap connected to the distal end, and defining an end face and a sidewall. A transition surface defined by the pilot cap extends between the end face and the sidewall. The transition surface extends at a first angle forming a first angled relief and then at a second angle forming a second angled relief.

12 Claims, 6 Drawing Sheets

(56) References Cited

U.S. PATENT DOCUMENTS

| | | | | |
|---|---|---|---|---|
| 4,075,794 | A * | 2/1978 | Blaylock | B24B 33/08 451/472 |
| 4,425,693 | A * | 1/1984 | Dickinson | B24B 39/023 29/90.01 |
| 5,050,352 | A * | 9/1991 | Estabrook | B24B 33/086 451/463 |
| 5,371,978 | A | 12/1994 | Higashikawa | |
| 2014/0057535 | A1 | 2/2014 | Pohlitz | |

* cited by examiner

HONING TOOL

TECHNICAL FIELD

The present disclosure relates to a head assembly for a honing tool for machining an inside diameter of a workpiece, such as a ring gear.

BACKGROUND

Honing is a machining process that utilizes an abrasive element (stones) including a large number of abrasive particles to remove material from a surface of a workpiece to improve surface geometry or finish, or to alter the dimensions of the workpiece. The honing process removes material from the workpiece by the relative rotation and reciprocating action between one or more honing tools and the workpiece. A variety of abrasives are used for honing, some of the more common abrasives include particles of silicon carbide, aluminum oxide, diamond, and cubic boron nitride. These abrasives are typically embodied in conventional or traditional honing tools which are rigid, hard members and can be used to produce the above-discussed honed characteristics on a wide variety of workpieces.

SUMMARY

According to one embodiment, a head assembly of a honing tool includes a carrier having a proximal end connectable to a spindle, a distal end, and a plurality of stones. The stones are disposed around a perimeter of the carrier and are configured to cut one or more surfaces of a work piece. The head assembly also includes a pilot cap connected to the distal end, and defining an end face and a sidewall. A transition surface defined by the pilot cap extends between the end face and the sidewall. The transition surface extends at a first angle forming a first angled relief and then at a second angle forming a second angled relief.

The head assembly may be connectable to a spindle of the honing tool. The spindle may be powered by a rotary-drive unit and rotates the head assembly. The stones machine a workpiece when the rotating head assembly engages with a desired portion of the workpiece. In one example, the head assembly is configured to machine an inner bore of a workpiece. Here, the head assembly may be sized and shaped to approximate the inner bore, albeit slightly larger.

In some embodiments, the head assembly has at least one wear pad disposed on an outer surface of the sidewall. The sidewall may define at least one recess that receives a portion of the at least one wear pad. The pilot cap also includes a backside that faces the carrier. The at least one wear pad may include a portion that extends beyond the backside increases the effective length of the pilot cap.

According to another embodiment, a honing tool includes a driven spindle and a head assembly. The head assembly includes a carrier having a proximal end connectable to a spindle, a distal end, and a plurality of stones. The head assembly also includes a pilot cap connected to the distal end. The pilot cap defines an end face, a sidewall, and a transition surface extending therebetween. The transition surface extends at a first angle and then at a second angle.

In some embodiments, the head assembly has at least one wear pad disposed on an outer surface of the sidewall. The sidewall may define at least one recess that receives a portion of the at least one wear pad. The pilot cap also includes a backside that faces the carrier. The at least one wear pad may include a portion that extends beyond the backside increases the effective length of the pilot cap.

According to yet another embodiment, a head assembly of a honing tool includes a carrier and a pilot cap. The carrier has a proximal end connectable to a spindle, a distal end, and a plurality of stones. The pilot cap is connected to the distal end and defines an end face, a sidewall, and a transition surface extending therebetween. A plurality of wear pads are disposed on an outer surface of the sidewall.

In some embodiments, the sidewall may define recesses that receives a portion of the wear pads. The pilot cap also includes a backside that faces the carrier. The at wear pads may include a portion that extends beyond the backside increases the effective length of the pilot cap.

In some embodiments, the pilot cap has a transition surface extending between the sidewall and the end face. The transition surface may extend at a first angle forming a first angled relief and then at a second angle forming a second angled relief.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
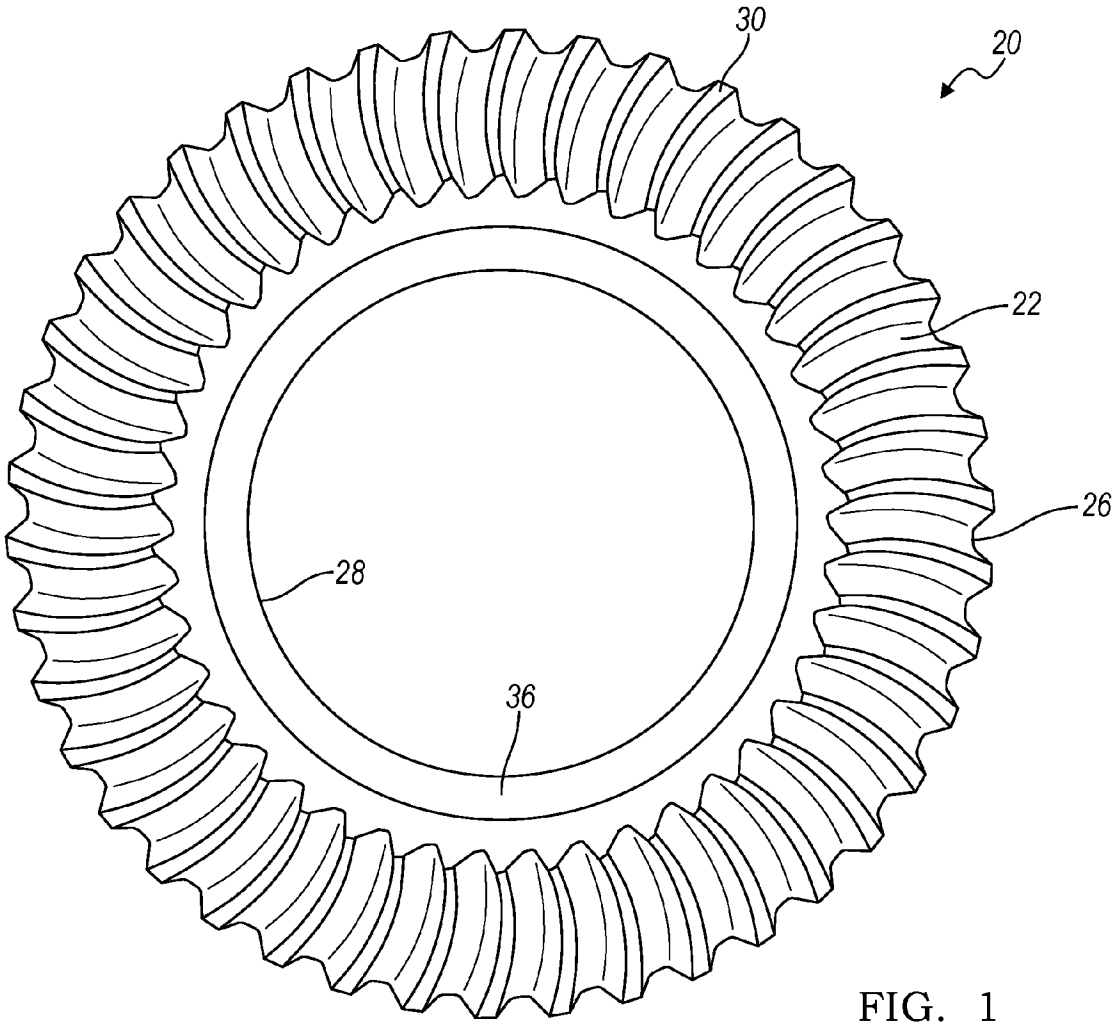
FIG. 1 is a top view of a ring gear.
Figure 2:
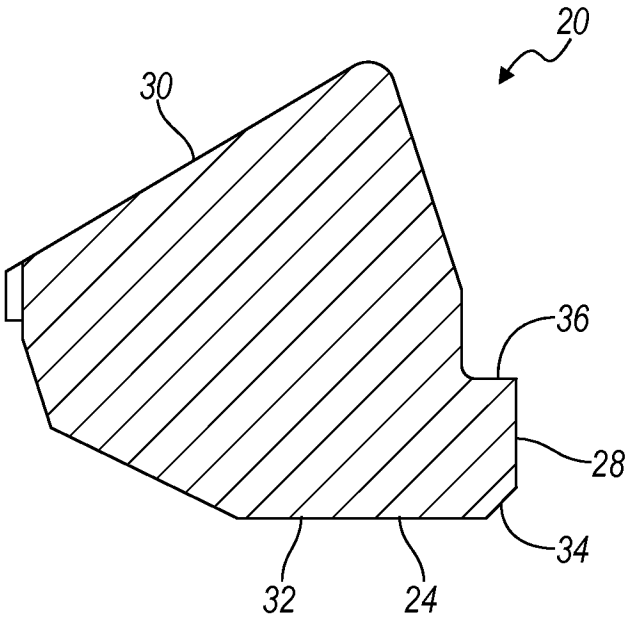
FIG. 2 is a partial side view, in cross section, of the ring gear of FIG. 1.

Referring to FIGS. 1 and 2, automobiles may include a differential for mechanically coupling a driveline of the powertrain to one or more driven axles. The differential may include a ring gear 20. The ring gear 20 includes a tooth side 22 and a back side 24. The tooth side 22 includes a plurality of teeth 30 that mesh with one or more pinion gears of the differential. The backside 24 has a machined surface 32 that is coupled to the driveshaft. The ring gear 20 includes an outer edge 26 that defines the outside diameter (OD) of the ring gear, and an inner bore 28 defining the inside diameter (ID) of the ring gear. A chamfered surface 34 extends between the inner bore 28 and the surface 32. A lip 36 is disposed around the bore 28 on the tooth side 22.

The ring gear 20 may be manufactured by first roughly cutting a blank into the desired shape. Next, the teeth are cut into the ring gear. After the teeth are formed, the ring gear 20 is heat treated. After heat treating, one or more finished surfaces are formed by secondary machining operations. The inner bore 28 requires a finished surface that is machined by a honing tool.

Figure 3:
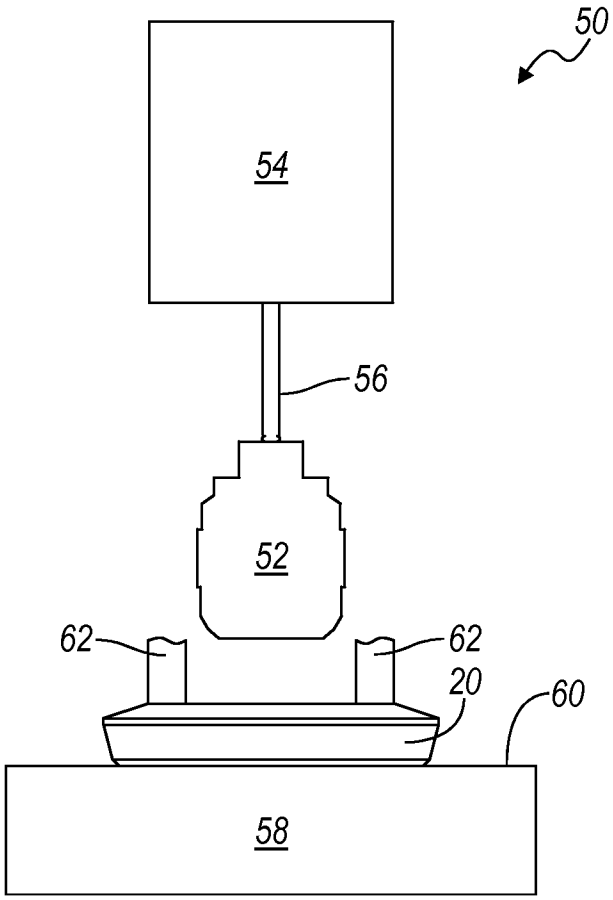
FIG. 3 is a diagrammatical elevation view of a honing tool.

Referring to FIG. 3, a honing tool 50 includes a head assembly 52 connected to a rotary drive unit 54 via a spindle 56. The head assembly 52 includes cutting stones and is the portion of the tool that machines the workpiece. The rotary drive unit 54 may be any type of apparatus configured to create rotational motion of the spindle 56. For example, the rotary drive unit 54 may be an electric motor, an internal-combustion engine or similar device. The tool 50 also includes a platform 58 defining a top surface 60. A workpiece is disposed on the top surface 60 and positioned into alignment with the head assembly 52. A fixture assembly 62 (partially shown) is used to clamp the workpiece in place. Machining is performed by rotating the head assembly and lowering the head assembly into engagement with the workpiece. The abrasion of the cutting stones against the workpiece removes material from the workpiece creating a finished surface.

In one embodiment, the honing tool 50 is specifically designed to hone the inner bore of a work piece—such as the inner bore 28 of the ring gear 20. The ring gear 20 is disposed on the platform 58 beneath the head assembly 52. The ring gear 20 is positioned in the tool such that the inner bore 28 is roughly centered with the head assembly 52. The ring gear 28, the head assembly 52, or both may float allowing the ring gear 20 to self-align when the head assembly 52 engages it. The ring gear 28 may have a greater range of motion than the head assembly 52. The inner bore 28 of the ring gear 20 is finished by lowering a rotating head assembly 52 into the roughly formed inner bore to remove the desired amount of material.

Figure 4:
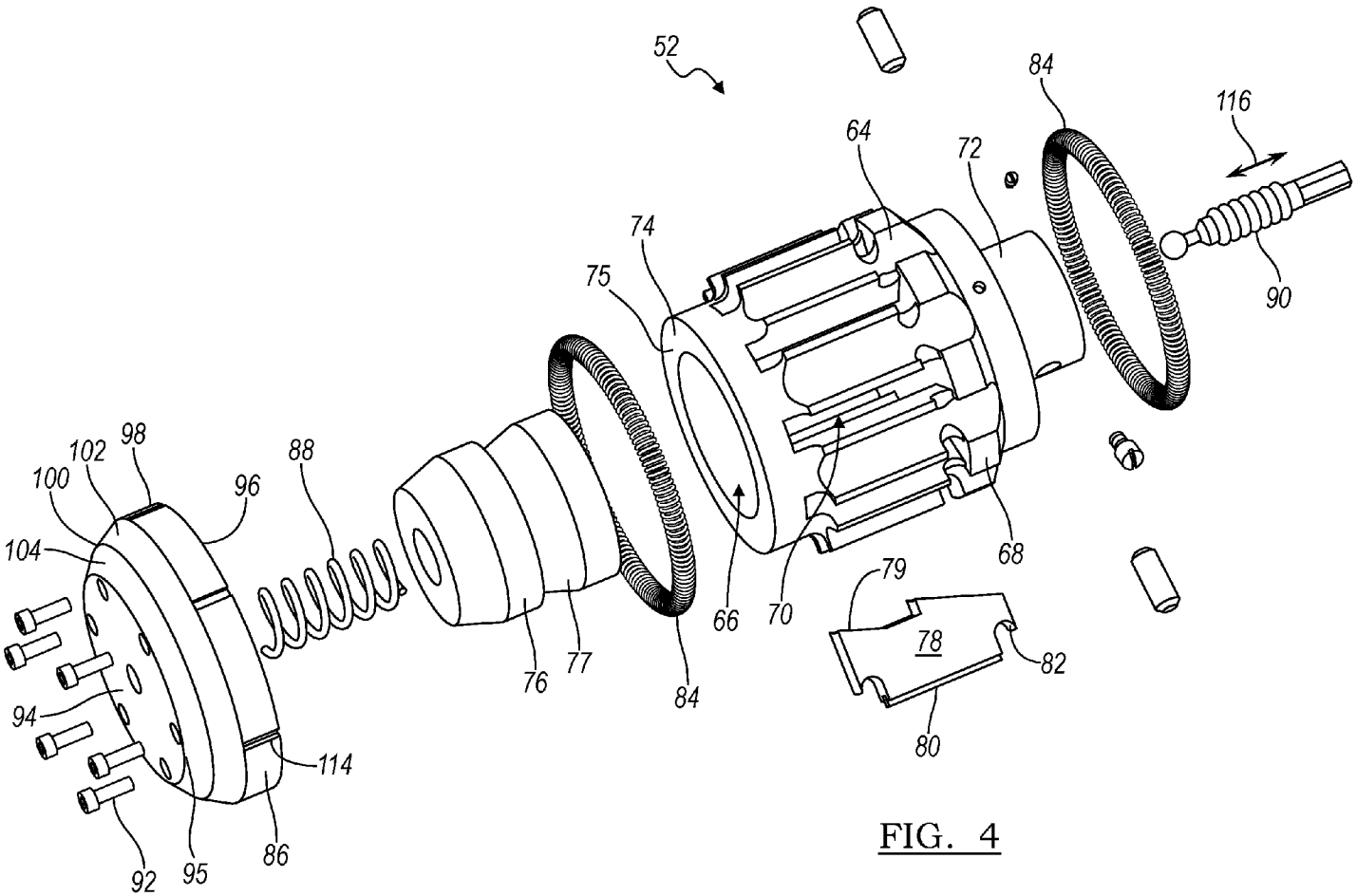
FIG. 4 is an exploded perspective view of a head assembly for a honing tool.
Figure 5:
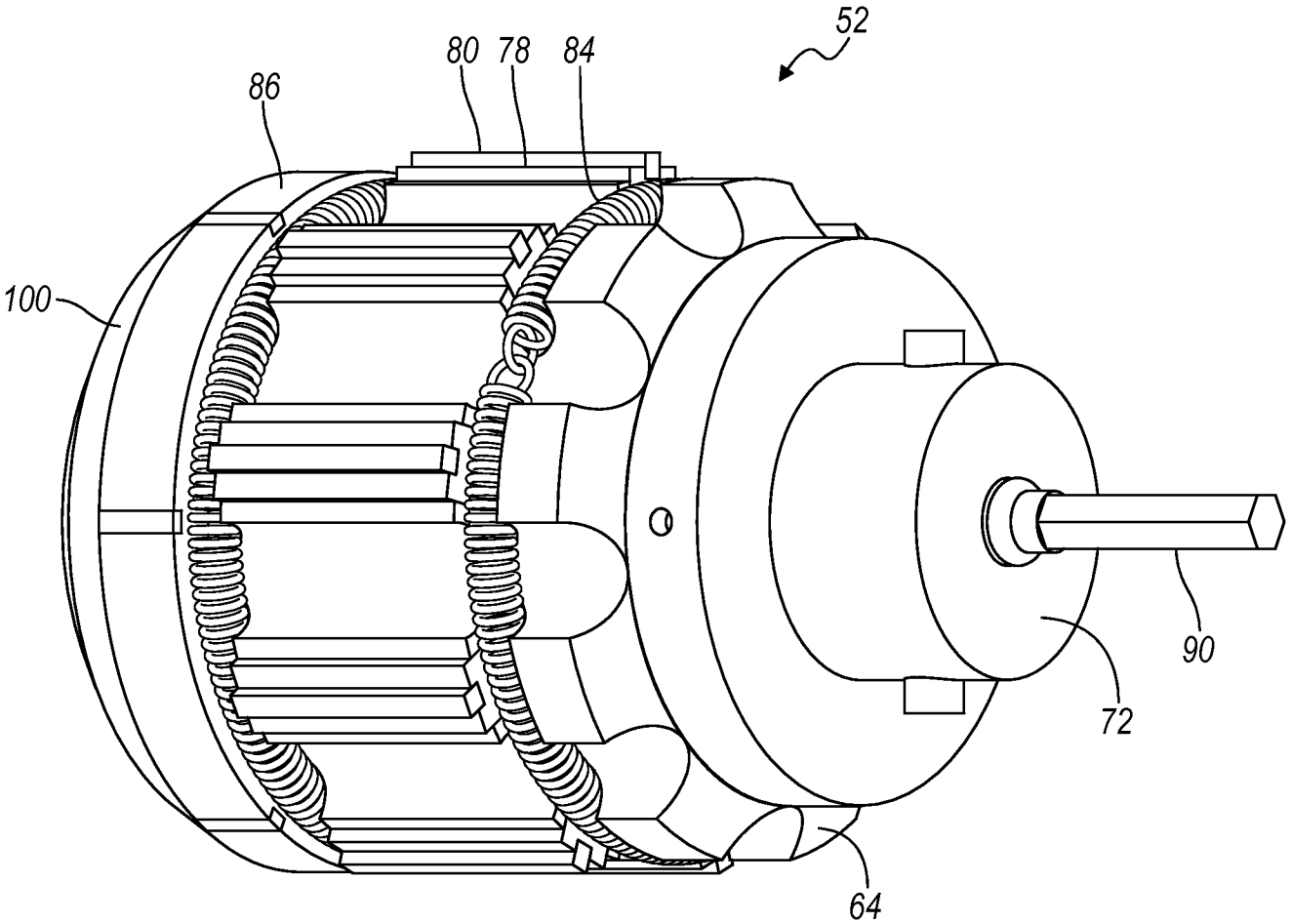
FIG. 5 is perspective view of the head assembly of FIG. 4.

Referring to FIGS. 4 and 5, an example head assembly 52 includes a carrier 64 that may be a circular cylinder defining an inner bore 66 and an outer side 68. The carrier includes a proximal end 72 and a distal end 74. An annular mounting surface 75 is formed on the distal end 74. The proximal end 72 is connectable to the spindle 56. The side wall of the carrier 64 defines a plurality of slots 70 that receive the stones 78. Each of the stones 78 includes a cutting edge 80 and hooks 82. An expansion cone 76 (also known as a stone adjuster) is disposed within the inner bore 66 and is configured to radially adjust the stones 78 relative to the outer side 68. The cone 76 defines an inclined surface 77 that engages with a backside 79 of the stones 78. Movement of the expansion cone 76 within the bore 66 in the axial direction 116 adjusts the stones 78 in and out of the slots 70. An adjustment bolt 90 is used to adjust the axial position of the cone 76. The stones 78 are held in the carrier 64 by a pair of expansion springs 84 that engage with the hooks 82 of the stones 78. A pilot cap 86 is attached to the mounting surface 75 by a plurality of fasteners 92. A compression spring is disposed within the inner bore 66 and engages between the expansion cone 76 and the pilot cap 86. The pilot cap 86 may be monolithic.

Figure 6:
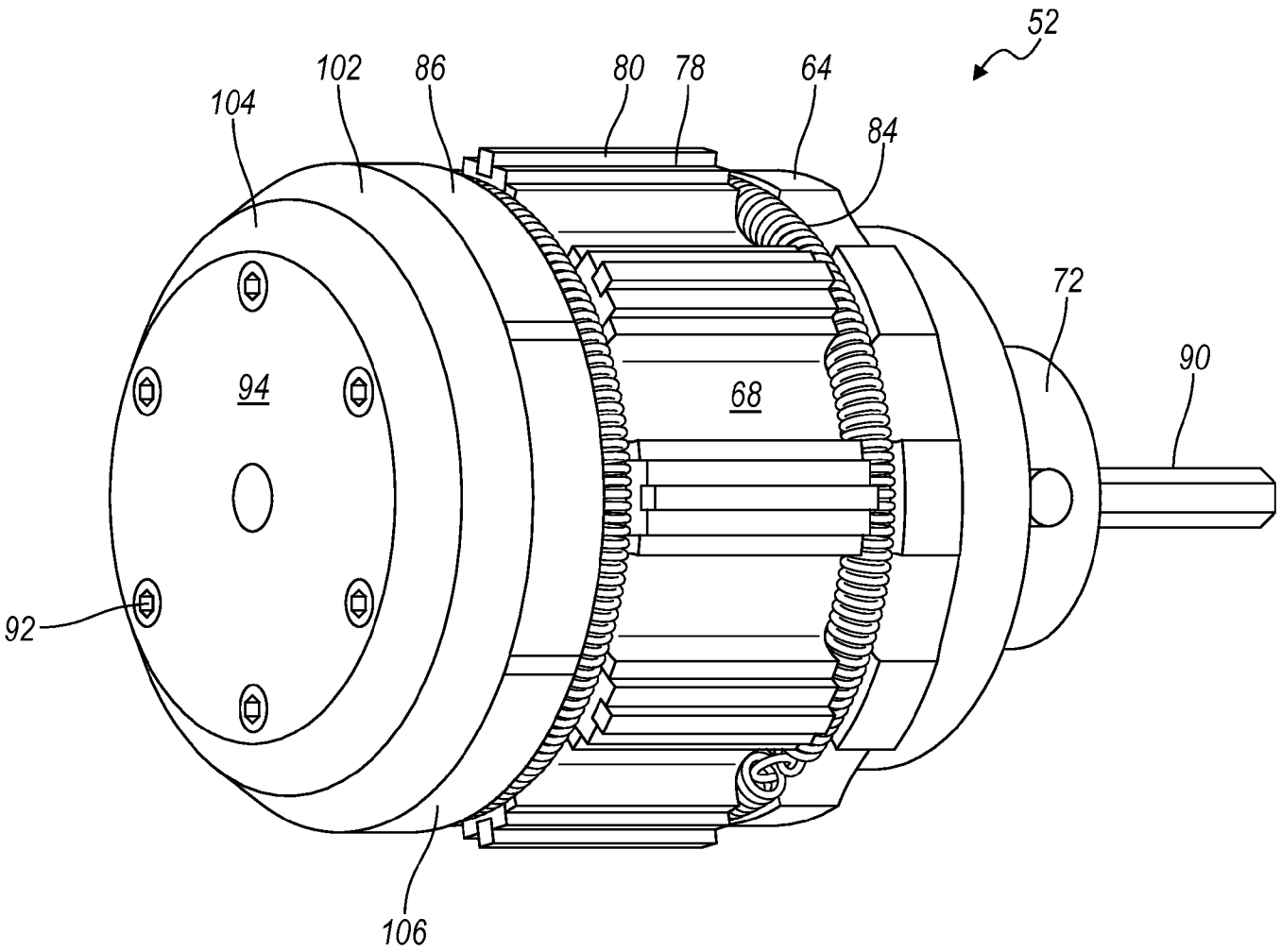
FIG. 6 is perspective view of the head assembly of FIG. 4.
Figure 7:
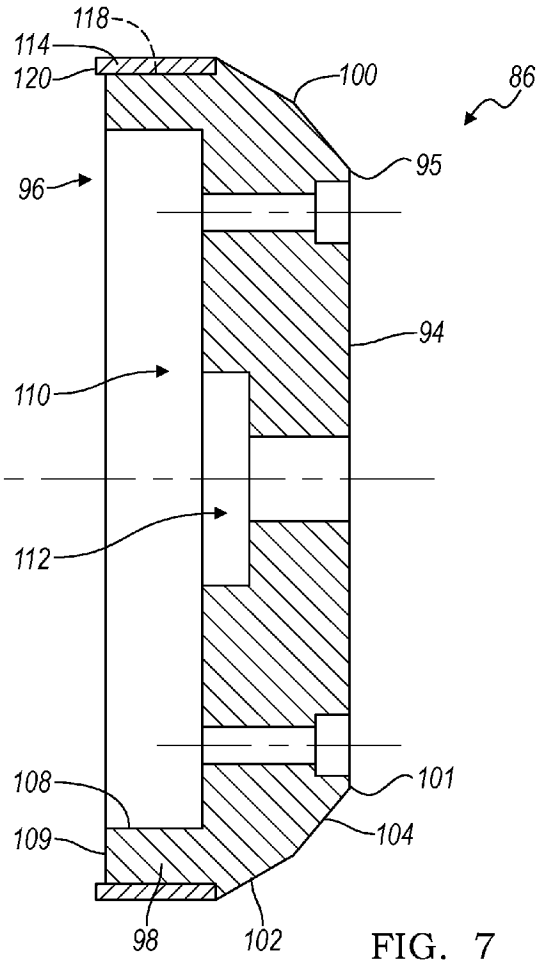
FIG. 7 is a side view, in cross section, of a pilot cap for the head assembly of FIG. 4.

Referring to FIGS. 6 and 7, the pilot cap 86 may include an end face 94 that defines the distal end of the head assembly 52 and a backside 96 that faces the carrier 64. The end face 94 may be generally planar and extend transversely to the axial direction 116 of the head 52. The end face 94 defines an annular edge 95. The pilot 86 also includes a sidewall 98 defining an outer surface 106, an inner surface 108, and an end surface 109. The sidewall 98 defines a cavity 110 that includes a spring recess 112 for receiving one end of the compression spring 88. A transition surface 100 extends between the outer surface 106 and the end face 94. The transition surface extends from the outer surface 106 at a first angle and then at a second angle relative to the sidewall 98. This creates a first angled relief 102 and a second angled relief 104. The reliefs cooperate forming a taper on the front end of the pilot, which allows the head assembly 52 to be inserted into the inner bore of the workpiece more easily and helps to center the inner bore to the tooling. The first angled relief 102 may extend from the sidewall 98 towards the end face 94 at an oblique angle that projects inwardly from the sidewall, and the second angled relief 104 may extend from the edge 95 to an end 101 of the first relief at an oblique angle that projects outwardly from the edge 95. The first angled relief 102 and the second angled relief 104 may extend at different angles relative to the sidewall 98. In the illustrated embodiment, the first angled relief 102 has a smaller angle relative to the sidewall 98 than the second angled relief 104.

The double-angle transition surface is more effective than a single-angle transition surface at smoothly engaging the workpiece ID with the pilot cap. A single-angle transition surface can cause popping of the workpiece due to a hard contact with the edge of the pilot cap upon entry into the ID. The double-angle transition surface engages the workpiece softer than the single angle and does not cause popping of the workpiece.

One or more wear pads 114 are disposed on the outer surface 106 of the sidewall 98. The sidewall 98 may define recesses 118 that each receives a portion of one of the pads 114. The pads 114 may be attached by braising or silver soldering. The wear pads 114 reduce wear on the pilot cap 86 to extend the life of the pilot, which is more expensive and harder to replace than the wear pads. A portion 120 of the wear pads 114 extends beyond the end surface 109 to ensure the head assembly 52 remains engaged with the inner bore 28 of the workpiece when the head assembly transitions from the pilot engaging the inner bore to the stones 78 engaging the inner bore.

Testing showed that, for certain workpiece-honing-head combinations, the spring gap caused the pilot cap to disengage with the inner bore prior to the stones engaging. When the pilot cap disengages with the workpiece, there is nothing to center the stones relative to the ID. This was causing the stones to chip resulting in tool failure. This was also causing damage to the workpiece as the stones were contacting unintended areas of the workpiece. The extended portions prevent this from occurring by effectively increasing the length of the pilot cap. Thus, the pilot cap is still engaged with the ID of the workpiece when the stones engage with the ID to center the carrier and prevent chipping of the stones.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated.

While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A head assembly of a honing tool comprising:

a carrier including stones and an end; and a monolithic pilot cap connected to the end and defining an end face, a sidewall axially and radially spaced from the end face, a first relief angled inwardly from the sidewall, and a second relief angled outwardly from the end face and intersecting the first relief, wherein the first and second reliefs have different angles relative to the sidewall, wherein the first relief is oriented at a first oblique angle relative the sidewall, and the second relief is oriented at a second oblique angle relative to the sidewall that is larger than the first oblique angle.

2. The head assembly of claim 1 wherein the end face has a circular edge defining a diameter that is smaller than a diameter of the sidewall, and the first and second reliefs cooperate to define a transition surface that extends outwardly from the edge towards the sidewall at oblique angles relative to the sidewall.

3. The head assembly of claim 2 wherein the first relief has a first end extending from the sidewall and terminating at a second end, and the second relief has a first end extending from the second end of the first relief and a second end terminating at the edge of the end face.

4. The head assembly of claim 1 wherein the sidewall of the pilot cap further includes an outer surface, and an inner surface defining an open cavity that extends into a backside of the pilot cap, and the end of the carrier is received in the cavity.

5. The head assembly of claim 1 wherein the carrier includes a cylindrical body having an outer sidewall that defines slots each receiving one of the stones.

6. The head assembly of claim 1 wherein the carrier defines an inner bore that slidably receives a stone adjuster therein, wherein the stone adjuster includes an inclined surface that engages with a backside of the stones, wherein axial movement of the stone adjuster within the inner bore causes the stones to radially move relative to a sidewall of the carrier.

7. A honing tool comprising;

a driven spindle; and a head assembly including a carrier having a cylindrical body with a proximal end connectable to the spindle, an annular mounting surface formed on a distal end of the body, and a plurality of slots that each receive a cutting stone, and a monolithic pilot cap having a front side defining an end face oriented perpendicularly relative to an axial direction of the head assembly, a sidewall parallel to the axial direction and spaced from the end face in the axial direction, and a backside attached to the mounting surface, the pilot cap further having a first angled relief extending from the sidewall towards the end face at an oblique angle that projects inwardly from the sidewall and a second angled relief extending from the end face to an end of the first angled relief at an oblique angle that projects outwardly from the end face to form a tapered transition surface configured to guide the head assembly into a workpiece, wherein the oblique angle of the first angled relief is smaller than the oblique angle of the second angled relief relative to the sidewall.

8. The honing tool of claim 7 further comprising a platform disposed beneath the head assembly and including a top surface configured to support the workpiece.

9. The honing tool of claim 7 further comprising a rotary drive unit coupled to the spindle.

10. The honing tool of claim 7 wherein the pilot cap further includes at least one wear pad disposed on an outer surface of the sidewall.

11. The honing tool of claim 10 wherein the outer surface defines at least one recess that receives a portion of the at least one wear pad.

12. The honing tool of claim 10 wherein the at least one wear pad includes a portion that extends past the backside.

* * * * *